US007387521B1

(12) United States Patent
Weber

(10) Patent No.: US 7,387,521 B1
(45) Date of Patent: Jun. 17, 2008

(54) CONNECTOR ASSEMBLY FOR END MOUNTING PANEL MEMBERS

(75) Inventor: Ronald Martin Weber, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/615,623

(22) Filed: Dec. 22, 2006

(51) Int. Cl.
*H01R 27/00* (2006.01)

(52) U.S. Cl. ..... 439/224; 439/31

(58) Field of Classification Search ..... 439/31, 439/288, 224, 11, 13, 29, 295, 284
See application file for complete search history.

(56) References Cited

U.S. PATENT DOCUMENTS 2,347,089 A * 4/1944 Donaldson ..... 403/345
4,273,401 A * 6/1981 Katzin ..... 439/286
4,632,475 A * 12/1986 Tomita ..... 439/1
4,657,320 A * 4/1987 Bamford et al. ..... 439/31
4,701,133 A * 10/1987 Worth ..... 439/13
4,863,388 A * 9/1989 Reimer et al. ..... 439/31
4,865,553 A * 9/1989 Tanigawa et al. ..... 439/31
4,877,409 A * 10/1989 Tanigawa et al. ..... 439/31
4,975,062 A * 12/1990 Evans et al. ..... 439/13
5,542,850 A * 8/1996 Frantz ..... 439/31
6,350,154 B1 * 2/2002 Fu ..... 439/638
6,386,884 B1 * 5/2002 Sloey ..... 439/11
6,561,853 B1 * 5/2003 Yu ..... 439/660
7,048,555 B2 * 5/2006 Ono ..... 439/83

* cited by examiner

*Primary Examiner*—Ross N Gushi

(57) ABSTRACT

A connector assembly is secured to a panel member for electrically coupling with a second connector assembly secured to a second panel member. Each of the connector assemblies includes a contact having a first portion and a second portion disposed at a predetermined spacing from each other. The predetermined spacing of each contact is configured and disposed to receive the second portion of the other contact. The second portions and corresponding first and second portions of the connector assembly and second connector assembly are pivotably connectable.

16 Claims, 9 Drawing Sheets

CONNECTOR ASSEMBLY FOR END MOUNTING PANEL MEMBERS

FIELD OF THE INVENTION

The present invention relates generally to electrical connector assemblies and, more particularly, to electrical connector assemblies for use with electrical panel members.

BACKGROUND OF THE INVENTION

Connector assemblies are required to provide electrical power or electrical or electronic control signals between components, such as computers, printers, auxiliary hardware, etc. Often, these components contain panel members, such as printed circuit boards, which are populated with miniaturized components to provide the desired electrical control. Typically, the connector assembly includes electrical contacts that extend from a housing that is secured adjacent to one end of the panel member. A mating connector assembly is configured for receiving the connector assembly. The operational reliability of the component is directly affected by the integrity of the connection. That is, if there is an insufficient electrical connection between the contacts, the components cannot operate as intended.

In addition, the electrical connector assemblies between adjacent panel members are configured to permit coupling by directing the electrical connector assemblies toward each other in only one direction.

What is needed is an electrical connector assembly that is secured to a panel member, which connector assembly being configured to couple with a second connector assembly that is secured to a second panel member, the connector assemblies capable of being brought into electrical contact with each other from a plurality of different directions.

SUMMARY OF THE INVENTION

The present invention relates to a connector assembly secured to a panel member for electrically coupling with a second connector assembly secured to a second panel member. Each of the connector assemblies include a contact having a first portion and a second portion disposed at a predetermined spacing from each other. The predetermined spacing of each contact is configured and disposed to receive the second portion of the other contact. The second portions and corresponding first and second portions of the connector assembly and second connector assembly are pivotably connectable.

The present invention further relates to a panel member electrically connectable to a second panel member. The panel member includes a connector assembly secured to the panel member for electrically coupling with a second connector assembly secured to the second panel member. Each of the connector assemblies includes a contact having a first portion and a second portion disposed at a predetermined spacing from each other. The predetermined spacing of each contact is configured and disposed to receive the second portion of the other contact. The second portions and corresponding first and second portions of the connector assembly and second connector assembly are pivotably connectable.

An advantage of the present invention is that mating electrical connector assemblies form pivotable connections.

A further advantage of the present invention is that the mating electrical connector assemblies can be brought together from different directions.

A still further advantage of the present invention is that the panel members of mating electrical connector assemblies are capable of remaining at a fixed orientation with respect to each other.

A yet further advantage of the present invention is that the orientation between panel members permits changes in orientation with respect to each other.

A still yet further advantage of the present invention is that it reduces the number of component parts required to manufacture the connector assemblies.

A further advantage is that the connector assembly contacts are hermaphroditic in nature.

A still further advantage is that the connector assemblies are scalable, so that any number of connector assemblies can be used to provide multiple connected positions (i.e., 2, 4, 6, etc.).

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
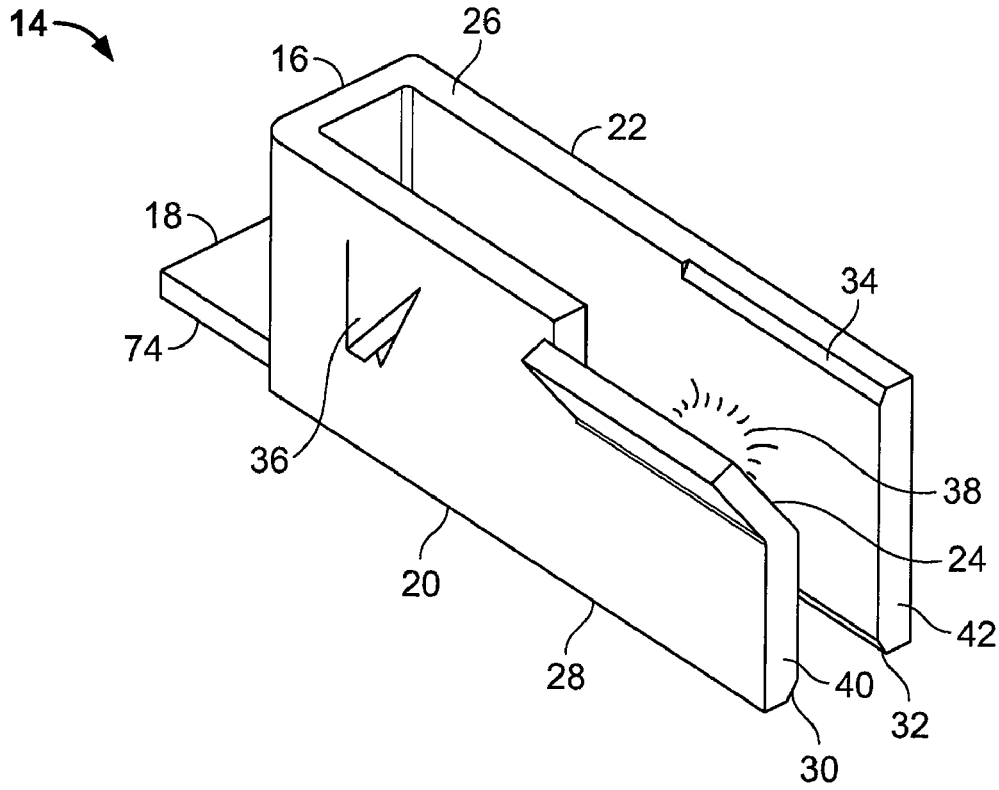
FIG. 1 is a top perspective view of an embodiment of an electrical contact of the present invention.
Figure 7:
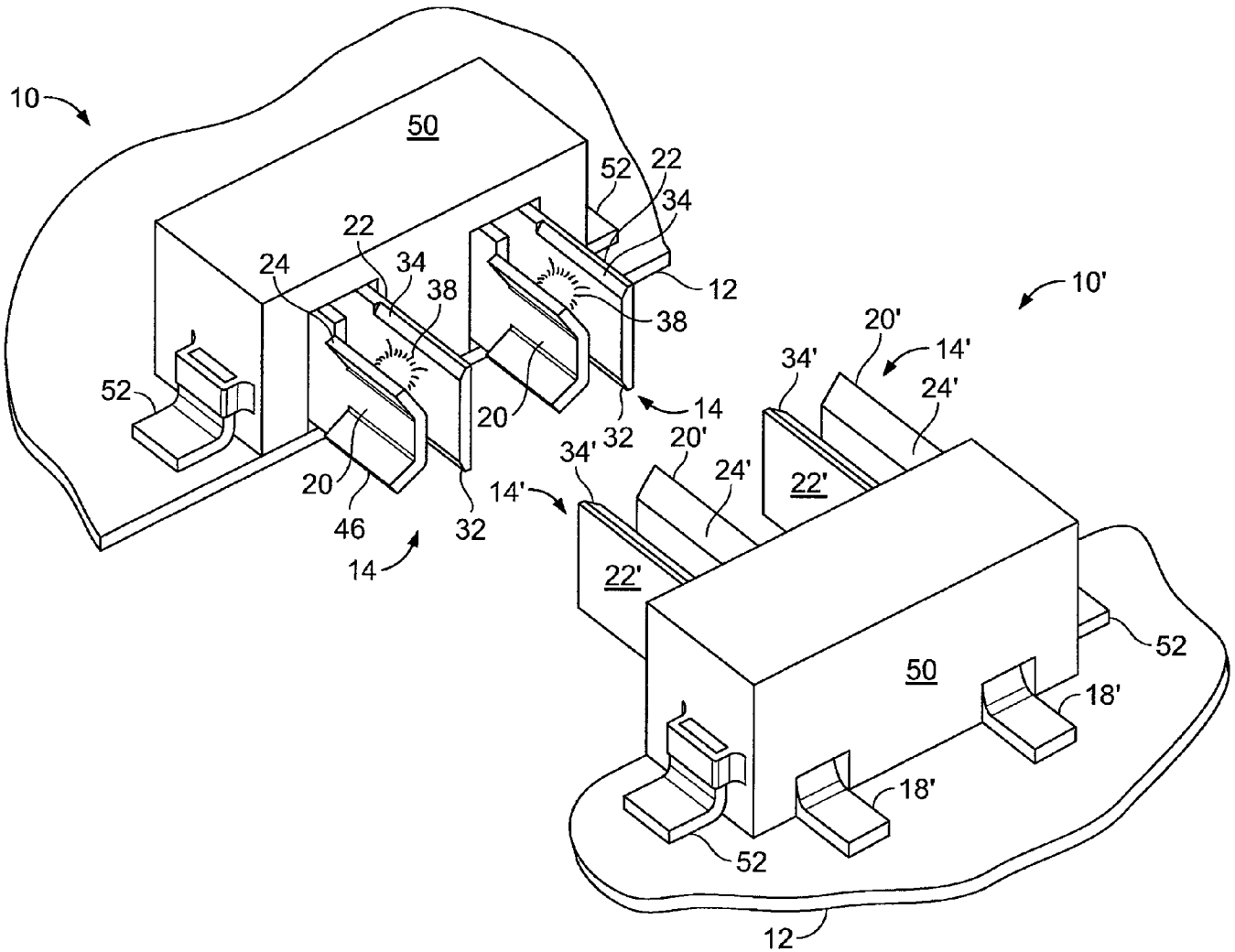
FIG. 7 is a top perspective view of mating electrical connector assemblies prior to coupling secured to respective panel members of the present invention.

Referring to FIGS. 1-5, an electrical connector assembly 10 (FIG. 5) according to the present invention includes a contact 14 that is configured to couple with another contact 14' (FIG. 7). In one embodiment, contacts 14 and 14' are substantially the same. As shown in FIG. 1, contact 14 includes a base 16 extending from one end to a first portion 20 and from the other end to a second portion 22. First portion 20 extends to an end 40 opposite base 16 and second portion 22 extends to an end 42 opposite base 16. In one embodiment, base 16, first and second portions 20, 22 each have an upper end 26 and a lower end 28, and first and second portions 20, 22 are substantially parallel. It is to be understood that the terms upper and lower are not limiting, but merely provided to more easily identify features of the present invention.

Figure 8:
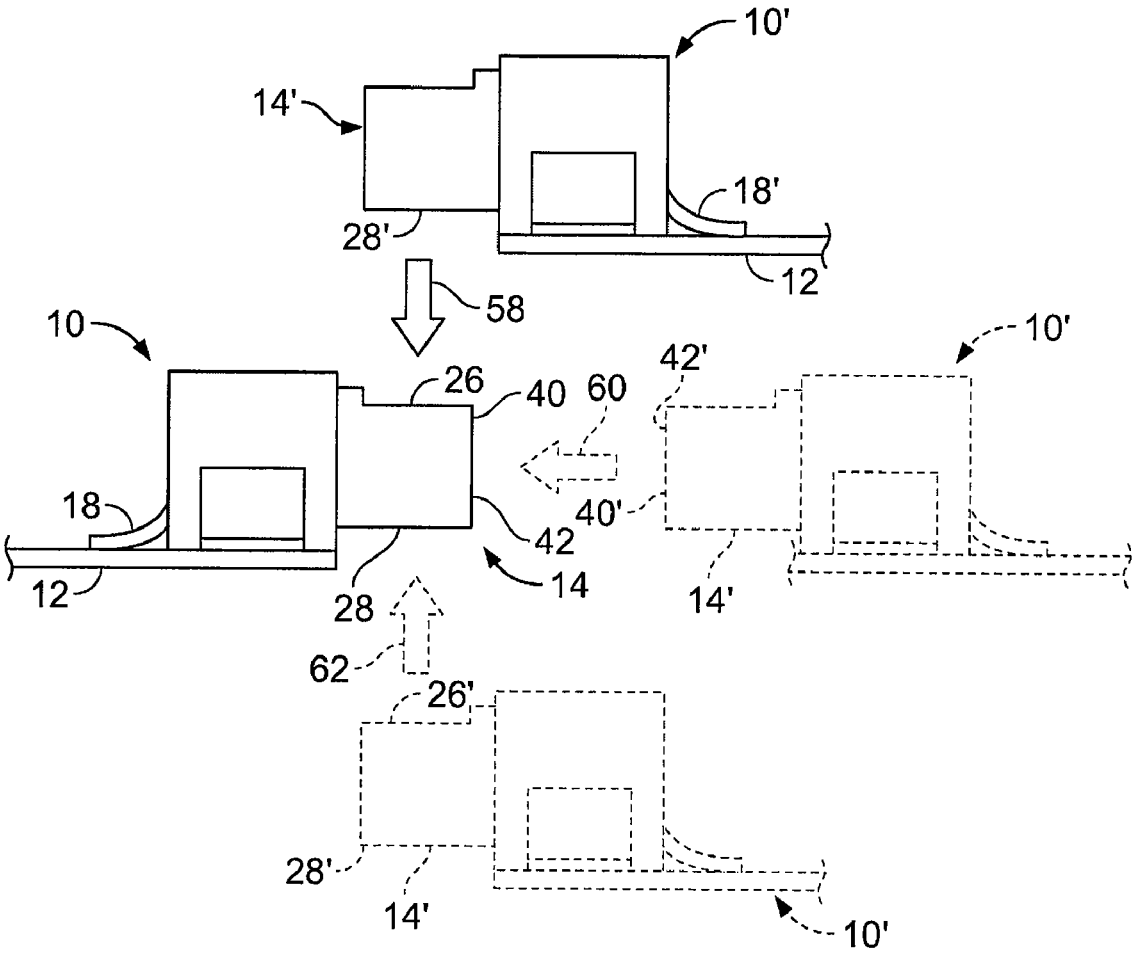
FIG. 8 is a schematic elevation view of mating electrical connectors of the present invention, showing a plurality of directions in which the connectors can be brought together.

As shown in FIG. 1, a foot 18 extends outwardly and substantially transverse to base 16 and has a surface 74 substantially coincident with or slightly offset and lower than lower end 28. In another embodiment (FIG. 2), surface 74 of foot 18 extends past, or below, lower end 28, and a foot 44 having a surface 76 extends transversely from lower end 28 of first portion 20, in effect raising contact 14 so that when contact 14 is placed upon a substantially flat surface, respective surfaces 74, 76 of feet 18, 44 are in contact with the flat surface. As shown in FIGS. 7 and 8, foot 18, 18' can be used to securely mount contact 14, 14' to a panel member 12. In one mounting technique (not shown), a solder containing paste is masked onto the surface of panel member 12 so that foot 18, 44 is disposed on the paste. Panel member 12 is then subjected to sufficient heat to flow the paste, establishing a bonded joint between panel member 12 and each foot 18, 44 (FIG. 2) or between panel member 12 and foot 18 (FIG. 1). However, other suitable conductive fastening techniques, including mechanical fasteners, adhesives or other thermal processes can be used to secure foot 18 or feet 18, 44 to panel member 12.

Figure 4:
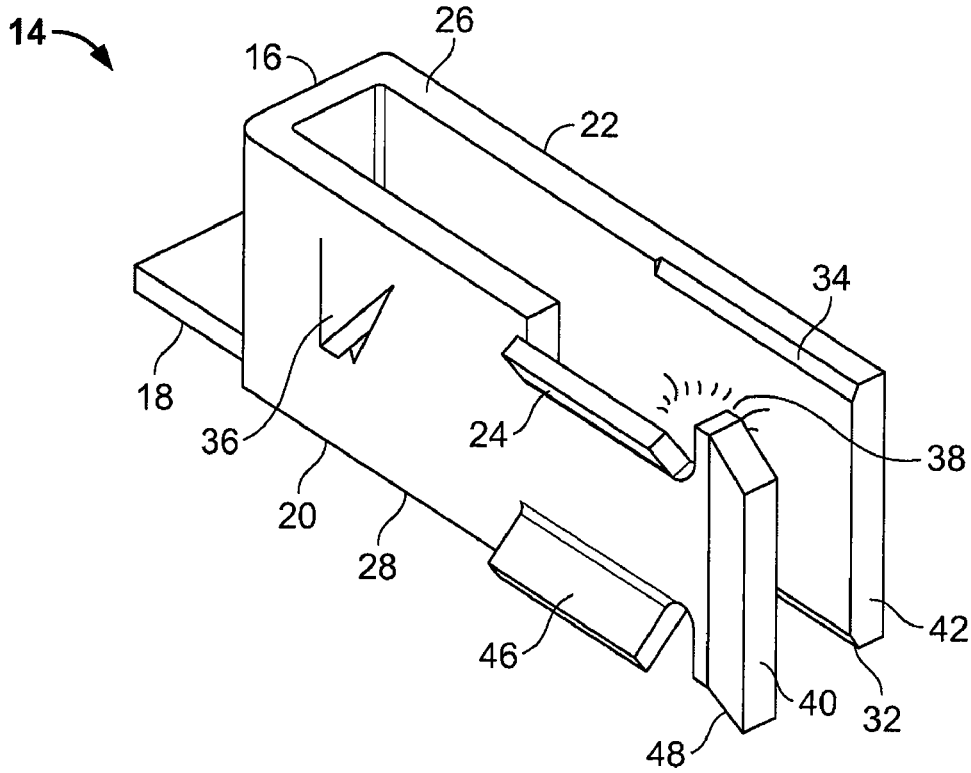
FIG. 4 is a top perspective view of another embodiment of an electrical contact of the present invention.
Figure 5:
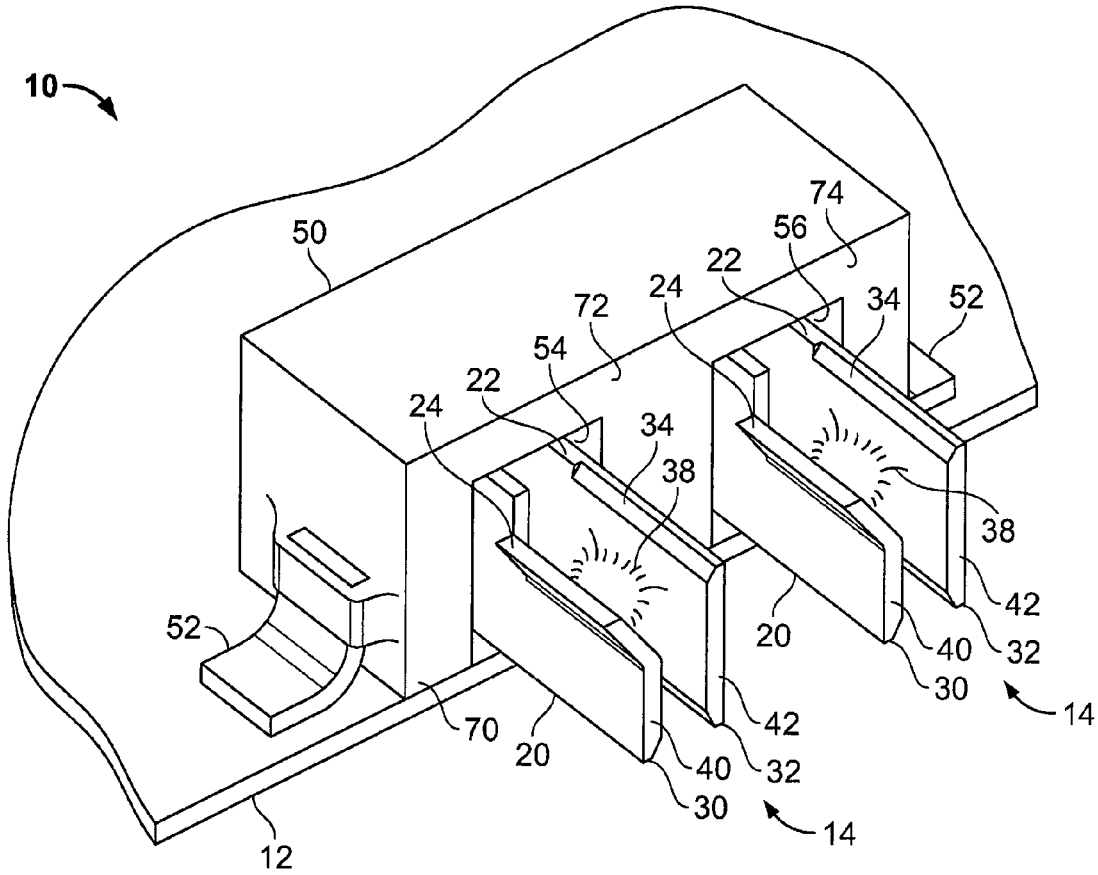
FIG. 5 is a top perspective view of an embodiment of a connector assembly secured to a panel member of the present invention.

In one embodiment, an interfering retainer 36 is formed in each of first portion 20 and second portion 22 to secure contact 14 to a housing 50 (FIG. 5). FIG. 1 shows an angled region 24 formed adjacent to upper end 26 and end 40 of first portion 20, and a taper 30 formed in first portion 20 adjacent to end 40 and lower end 28 and facing second portion 22. As shown in FIGS. 1-4, an optional protrusion 38 extends outwardly from second portion 22 toward first portion 20 to provide an improved electrical connection with a mating connector. For reasons discussed in further detail below, contact 14 forms a pivotable connection with a corresponding contact 14' (FIG. 7).

Figure 2:
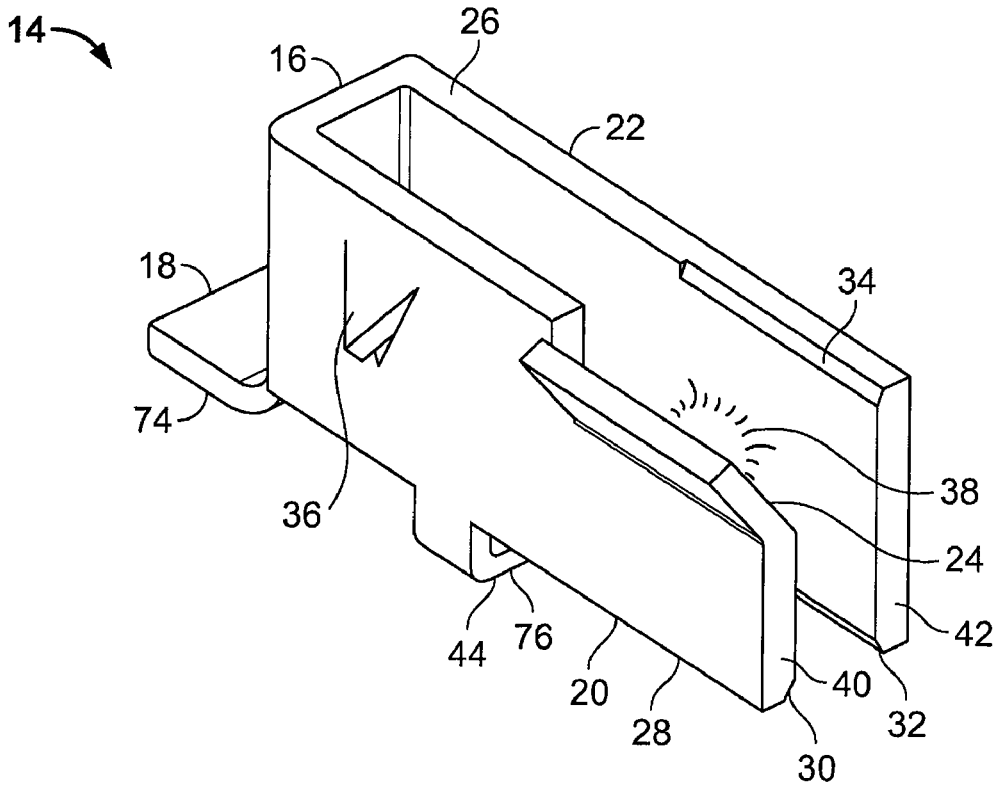
FIG. 2 is a top perspective view of an embodiment of an electrical contact of the present invention.
Figure 3:
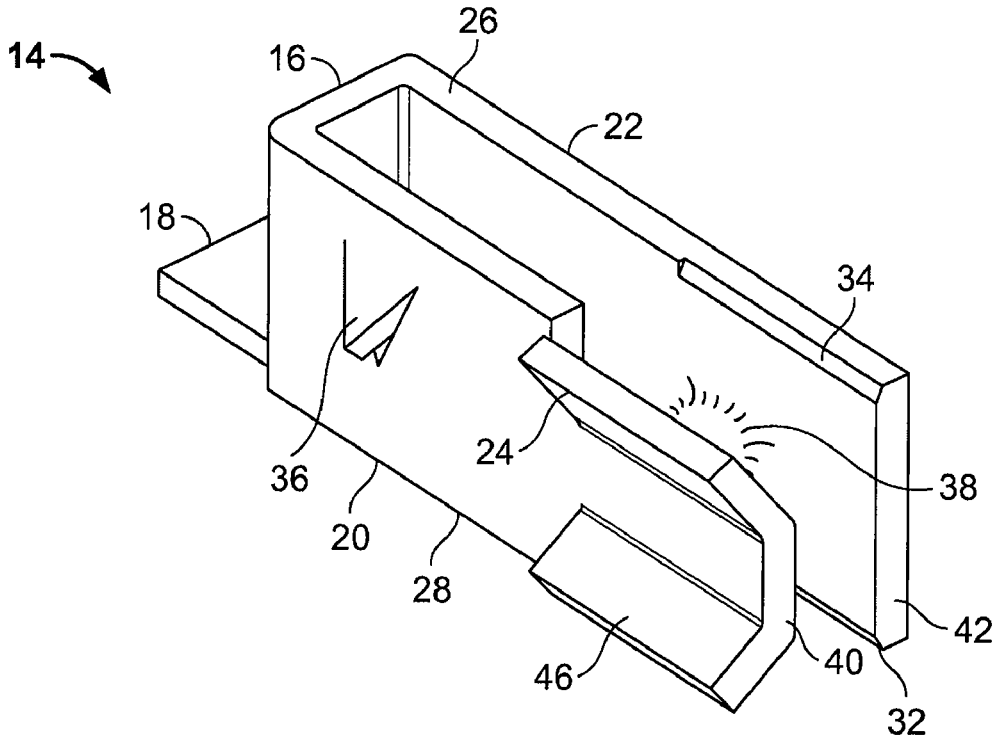
FIG. 3 is a top perspective view of a further embodiment of an electrical contact of the present invention.

Referring to FIG. 3, which is another embodiment of contact 14 that is otherwise similar to the contact 14 embodiment of FIG. 2, an angled portion 46 is formed adjacent to lower end 28 and end 40 of first portion 20. Referring to FIG. 4, which is another embodiment of contact 14 that is otherwise similar to the contact embodiment of FIG. 3, an angled portion 48 is formed adjacent to end 40 of first portion 20.

Referring to FIG. 7, contact 14 is composed of a metal, such as brass or phosphor bronze, or other sufficiently electrically conductive material so that electrical energy is conducted from feet 18, 44 (not shown) through first and second portions 20, 22 to a mating contact 14' in a manner that does not adversely affect the performance of components mounted to each panel member 12.

Referring to FIG. 5, a housing 50 includes openings 54, 56 each configured to receive a contact 14. To secure housing 50 to panel member 12 as shown in FIG. 5, a foot 52 or a plurality of feet 52 that is secured to housing 50 is brought into contact with panel member 12, foot 52 being secured to panel member 12, for example in a manner similar to the technique used to secure feet 18, 44 to panel member 12 as previously discussed. Contact 14 is secured to housing 50 by virtue of retainers 36 (FIG. 1) that engage opposing walls of openings 54, 56, in one embodiment of housing 50. As shown in FIG. 5, housing 50 is configured so that first and second portions 20, 22 are disposed substantially perpendicular to panel member 12. While also as shown in FIG. 5, angled regions 24 and tapers 30, 32, 34 extend outwardly from housing 50 through openings 54, 56, in an alternate embodiment, front surface portions 70, 72, 74 can extend outwardly toward ends 40, 42 of first and second portions 20, 22 to vertically separate and enclose first and second portions 20, 22. Housing 50 can be composed of any material, such as nylon or polyester thermoplastics, having sufficient electrical insulating properties and strength and stiffness properties suitable for use with connector assembly 10.

Figure 6:
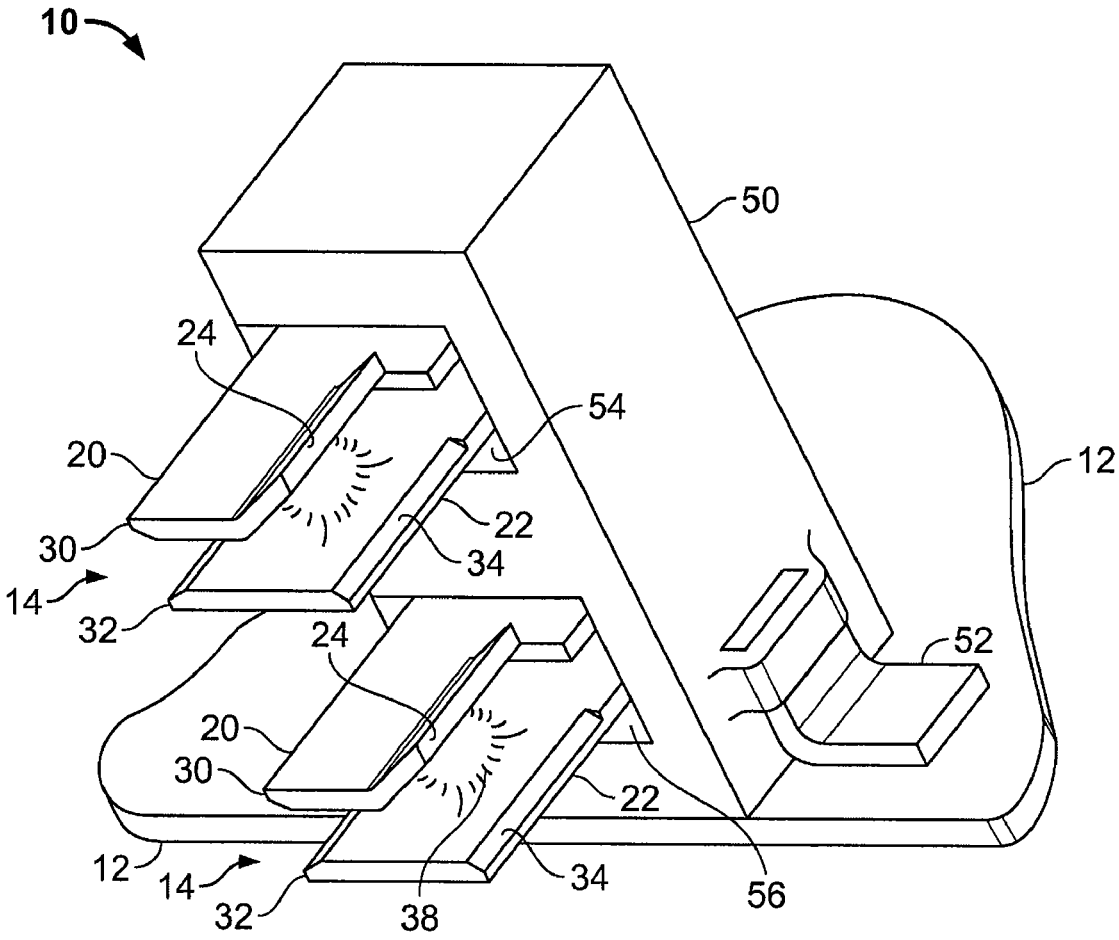
FIG. 6 is a top perspective view of an embodiment of a connector assembly secured to a panel member of the present invention.
Figure 15:
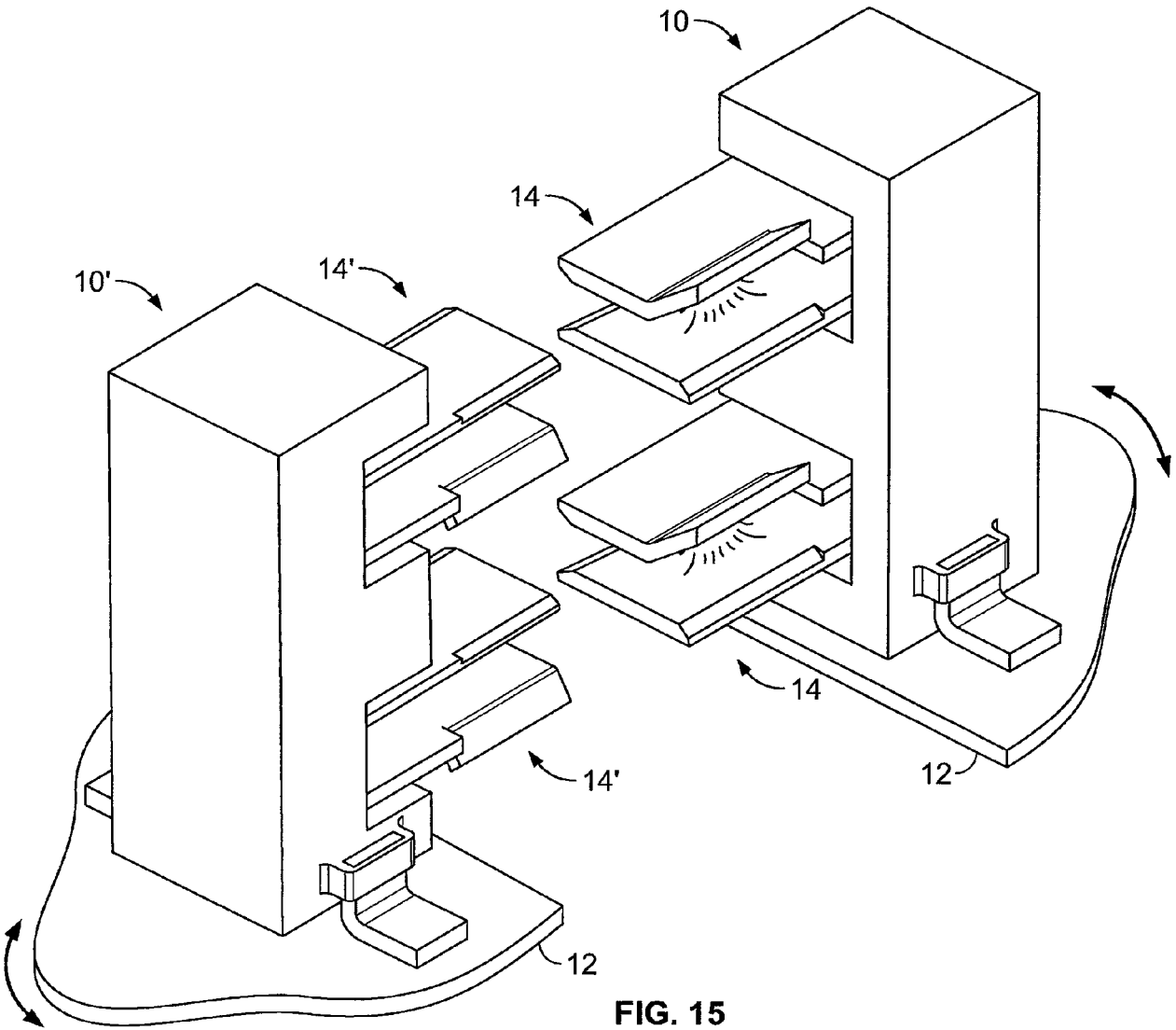
FIG. 15 is a top perspective view of mating electrical connector assemblies prior to coupling, with connector assemblies configured similar to FIG. 6, secured to respective panel members of the present invention.

Referring to FIG. 6, housing 50 is similar to the embodiment of FIG. 5, except that housing 50 in FIG. 6 is configured to secure contacts 14 so that first and second portions 20, 22 are arranged horizontally along the surface of panel member 12, i.e., substantially parallel to panel member 12, with contacts 14 disposed substantially perpendicular, i.e., stacked vertically, to the panel member 12. In other words, as shown in FIG. 6, housing 50 is configured to secure contacts 14 so that first and second portions 20, 22 are arranged vertically along a portion of panel member 12 with first and second portions disposed substantially parallel to panel member 12. Stated another way, to achieve housing 50 of FIG. 6, housing 50 of FIG. 5 is rotated 90 degrees, it being understood that contacts 14 are modified in a manner known in the art so that contacts 14 are in electrical communication with panel member 12. Upon connecting contacts 14 of the connector assemblies 10 of each of FIGS. 5 and 6, panel members 12 would be perpendicular to each other. Alternately, connecting two panel members 12 as shown in FIG. 15 with mating connector assemblies similar in nature to that shown in FIG. 6, permits panel members 12 to rotate substantially in the plane of the panel members 12, the extent of rotation being limited by the mating panel member 12.

FIG. 7 shows mating connector assemblies 10, 10' aligned for coupling, each connector assembly 10, 10' secured to a respective panel member 12. Upon directing each connector assembly 10' into engagement with its respective connector assembly 10, second portion 22' is received between corresponding first and second portions 20, 22. Likewise, second portion 22 of connector assembly 10 is received between corresponding first and second portions 20', 22' of connector assembly 10'. Due to the construction of contacts 14, as shown by FIG. 8, connector assemblies 10, 10' can be brought together from a plurality of directions. For example, contacts 14' of connector assembly 10' can be brought into mating contact or coupled with contacts 14 of connector assembly 10 along direction 58. That is, from a position vertically above contacts 14, contacts 14' can be lowered along direction 58 so that lower end 28' of contacts 14' engages upper end 26 of contacts 14 until full engagement or coupling is achieved.

Alternately, contacts 14 of connector assembly 10 and contacts 14' of connector assembly 10' can be coupled or brought together to achieve mating contacts 68 (FIG. 8 along direction 60. In other words, where contacts 14, 14' are aligned, contacts 14' can be moved along direction 60 so that ends 40, 42 begin to engage ends 40', 42' until full engagement is achieved. Engagement along direction 60 can be made easier when one first portion 20, 20' includes an angled portion 48 (FIG. 4). In addition, contacts 14 of connector assembly 10 and contacts 14' of connector assembly 10' can be brought into mating contact or coupled with connector assembly 10 along direction 62. That is, from a position vertically below contacts 14, contacts 14' can be raised along direction 62 so that upper end 26' of contacts 14' engages lower end 28 of contacts 14 until full engagement or coupling is achieved.

Figure 9:
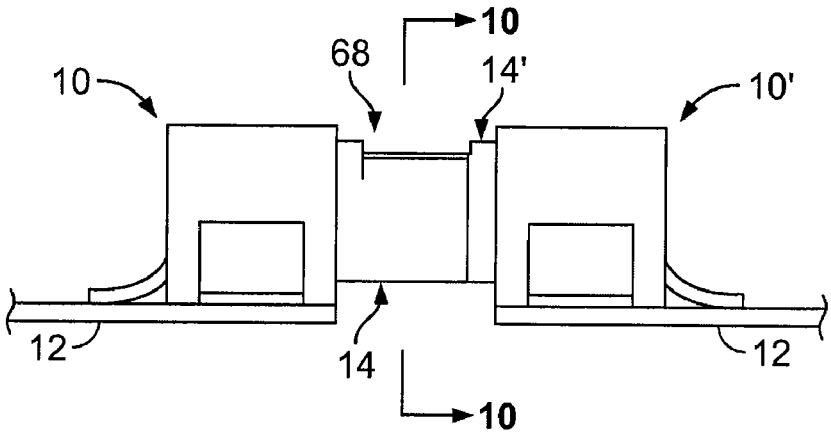
FIG. 9 is an elevation view of coupled electrical connector assemblies of the present invention.
Figure 14:
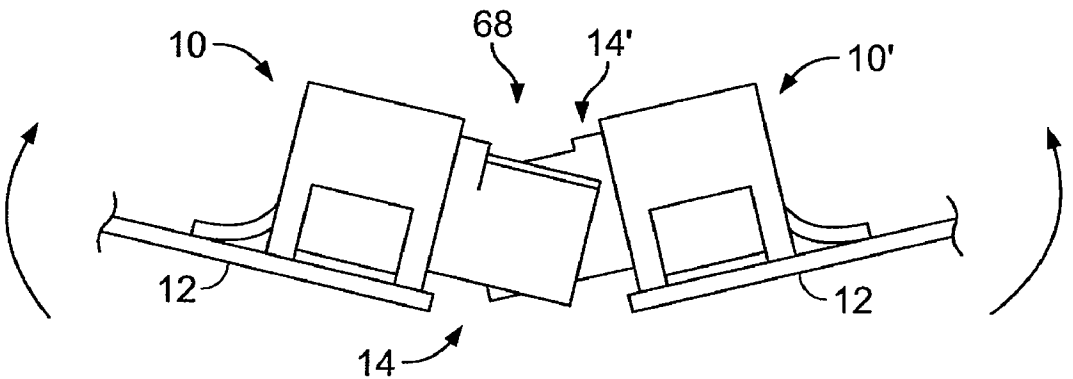
FIG. 14 is an elevation view similar to FIG. 9, except each coupled electrical connector assembly is rotated, i.e., pivotably connected, with respect to the other connector assembly of the present invention.

It is to be further noted that while connector assemblies 10, 10' can be brought together from a plurality of directions, by virtue of the pivotable or hinge-like connections, the panel members 12 of connector assemblies 10, 10' can either be maintained parallel to each other, or continuously rotated with respect to each other, such as, maintained non-parallel to each other. That is, the term pivotable connection as used herein is defined to mean that in the case of mating contacts 14 and 14', each contact can be rotated with respect to each other, such as comparing FIGS. 9 and 14. In other words, as shown in FIG. 9, contacts 14 and 14' are mated so that corresponding panel members 12 are disposed substantially parallel to each other. As shown in FIG. 14, contacts 14 and 14' are rotated with respect to each other so that the corresponding panel members 12 are disposed at an angle to each other. However, while a pivotable connection as shown between FIGS. 9 and 14 are hinge-like, the pivotable connection is not constrained to rotate about a specific axis. Stated another way, unlike a hinge, the pivotable connection of the present invention lacks a hinge pin, thus permitting an amount of translational sliding movement between contacts 14 and 14'. In addition, as previously discussed with respect to mating the connector assemblies of FIGS. 5, 6, alteration of housing 50 constructions can provide any orientation, i.e., any angular measurement, between panel members 12, which orientation being changeable, as desired.

Figure 10:
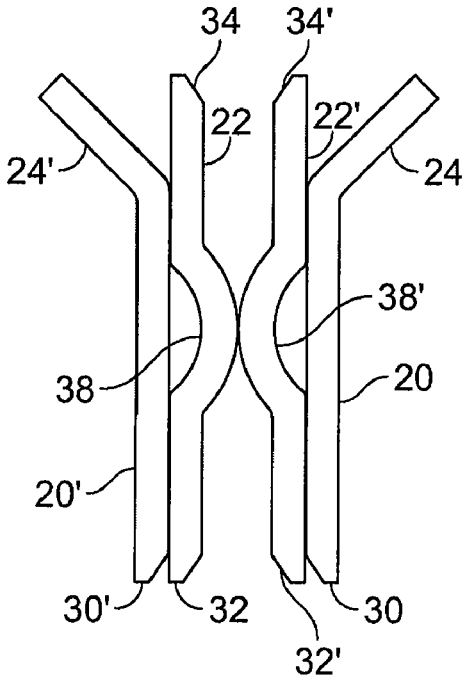
FIGS. 10-12 are cross sections of embodiments of mating connector contact constructions of the present invention.
Figure 11:
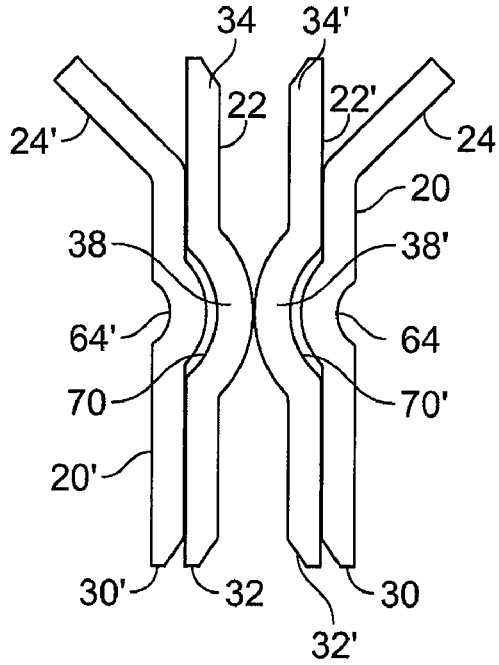
Figure 12:
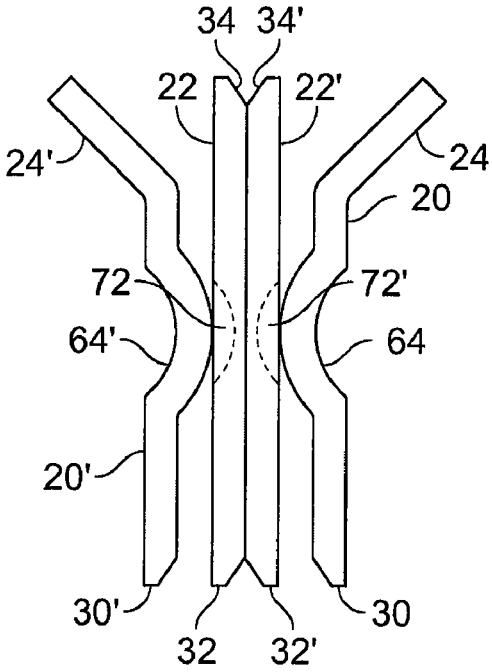

In addition to providing pivotable connections between coupled connector assemblies 10, 10', the connections achieved also provide an enhanced electrical connection therebetween. For example, FIG. 9 shows a pair of coupled electrical connector assemblies having mating contacts 68. FIGS. 10-12 are cross sections each taken along line 10-10 of FIG. 9 for one of the pair of mating contacts 14, 14'. For convenience, mating contacts 14, 14' are shown as identical components, with the only difference between corresponding portions being the superscripted apostrophe "'" following the numerical designation. Thus, second portion 22 of contact 14 is secured between first portion 20' and second portion 22' of contact 14', and likewise, second portion 22' of contact 14' is secured between first portion 20 and second portion 22 of contact 14. To enhance the electrical connection between mating contacts 68, protrusions 38, 38' are employed, such as in FIGS. 1-4. Protrusion 38 increases the effective thickness of second portion 22, and is sized so that the effective thickness of second portion 22 is greater than the distance between first and second portions 20', 22'. Thus, upon the insertion of second portion 22, including protrusion 38, between first and second portions 20', 22', first and second portions 20', 22' are urged further apart, producing a compressive contact force on opposite sides of second portion 22 and protrusion 38. This compressive force provides improved electrical contact between the abutting portions of second portion 22, including protrusion 38 and corresponding first and second portions 20', 22'.

Similarly, protrusion 38' increases the effective thickness of second portion 22', and is sized so that the effective thickness of second portion 22' is greater than the distance between first and second portions 20, 22. Thus, upon the insertion of second portion 22', including protrusion 38', between first and second portions 20, 22, first and second portions 20, 22 are urged further apart, producing a compressive contact force on opposite sides of second portion 22' and protrusion 38'. This compressive force provides improved electrical contact between the abutting portions of second portion 22', including protrusion 38' and corresponding first and second portions 20, 22. As shown in FIG. 10, protrusions 38, 38' abut each other. While protrusions 38, 38' have been generally depicted in the figures as having a spherical or circular profile, it is to be understood that the protrusions can have any number of suitable shapes, including flattened apexes to increase the amount of surface area between the protrusion 38, 38' and the adjacent first or second portion 20, 20', 22, 22' of contact 14, 14'.

In another embodiment of mating contacts 68, FIG. 11 is similar to FIG. 10, with the inclusion of protrusions 64, 64' formed in respective first portions 20, 20'. As shown, protrusions 64, 64' extend outwardly from respective first portions 20, 20' in the same direction as respective protrusions 38, 38' formed in adjacent second portions 22, 22' when contacts 14, 14' are coupled. In one embodiment, protrusions 64, 64' are smaller than protrusions 38, 38'. However, protrusions 64, 64' are sized and disposed so that protrusions 64, 64' and corresponding protrusions 38, 38' are aligned when mating contacts 68 are achieved. Upon sufficient movement of contact 14 with respect to contact 14', protrusions 64, 64' abut indented portion 70, 70' opposite protrusions 38, 38' to resist further movement in the direction of the abutting contact. Stated another way, protrusions 64, 64' act to help maintain abutting protrusions 38, 38' in abutting contact with each other, providing an enhanced physical and electrical contact between mating contacts 68.

In another embodiment of mating contacts 68, FIG. 12 is similar to FIG. 11, with the exclusion of protrusions 38, 38'. That is, as shown, protrusions 64, 64' are enlarged, and protrusions 38, 38' are substantially removed. In this construction, while protrusions 64, 64' are directed toward each other when contacts 14, 14' are coupled, protrusions 64, 64', unlike protrusions 38, 38' as shown in FIG. 11, do not abut each other. Stated another way, upon coupling, protrusions 64, 64' each abut a substantially flat surface of second portion 22, 22', thereby introducing additional stability as compared with constructions in which the protrusions are directly abutting each other. In another embodiment as shown in FIG. 12, instead of there being a protrusion 38, 38' that deforms both surfaces of second portion 22, 22', i.e., a protrusion on one surface and an indention in the opposed surface (see FIG. 11), the region of second portion 22 abutting protrusion 64' has only an indention 72 on one side of second portion 22 and is substantially nondeformed on the opposite surface. Similarly, the region of second portion 22' abutting protrusion 64 has only an indention 72' on one side of second portion 22' and is substantially nondeformed on the opposite surface. This construction helps to maintain protrusions 64, 64' in abutting contact with corresponding indentations 72, 72' so that mating contacts 68 are more stable and resist movement to inadvertently uncouple mating contacts 68. In other words, corresponding indentations 72, 72' form positive detents to minimize inadvertent uncoupling while also providing tactile feedback during mating.

Figure 13:
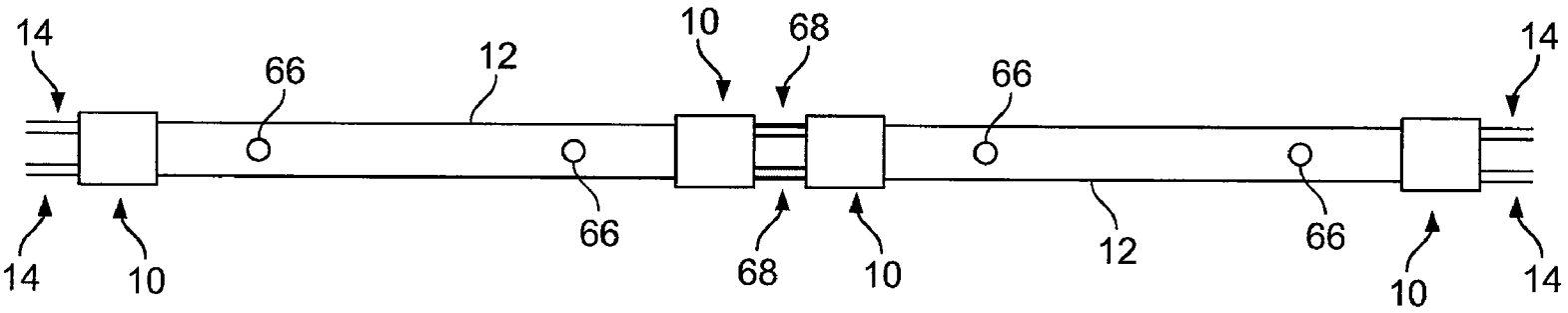
FIG. 13 is an elevation view of an application showing a pair of coupled connectors of different panel members of the present invention.

Referring to FIG. 13, an application of connector assemblies 10 with panel members 12 is discussed. As shown, panel members 12 contain light emitting diodes 66 for providing illumination to a structural space (not shown). Panel members 12 are secured in position, such as by an adhesive strip, so that once affixed to a surface of the structural space, removal is extremely difficult, if not impossible to achieve. Since the panel members 12 may be of extended length either singly or in total, it is not practical for an installer to pre-assemble all of the panel members 12 together prior to installation. Additionally, once a first panel member 12 is affixed to the structural space surface, it is not possible to couple a second panel member 12 to the first panel member 12 using conventional "straight-on" end-to-end connections. That is, contacts 14 must be configured to permit coupling from different directions, such as direction 58 (FIG. 8), which is permitting by the present invention.

It is to be understood that while the connector assemblies shown contain one pair of connector contacts secured in a housing, that one connector contact or more than two connector contacts can be contained in a housing to form a connector assembly. Further, a plurality of connector assemblies can be used to interconnect adjacent panel members.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly (10) secured to a panel member for electrically coupling with a second connector assembly (10') secured to a second panel member, the connector assembly (10) comprising:

a contact (14) having a first portion (20) and a second portion (22) disposed at a predetermined spacing from each other, the second connector assembly (10') including a contact (14') having a first portion (20') and a second portion (22') disposed at a predetermined spacing from each other, the predetermined spacing of the contact (14) of the connector assembly (10) being configured and disposed to receive the second portion (22') of the contact (14') of the second connector assembly (10'), the contact (14') of the second connector assembly (10') being configured and disposed to receive the second portion (22) of the contact (14) of the connector assembly (10), the panel assemblies can be maintained parallel or non-parallel to each other while the connector assemblies (10, 10') are brought together from a plurality of directions; and wherein the second portion (22') of the second connector assembly (10') and corresponding first and second portions (20, 22) of the connector assembly (10), and the second portion (22) of the connector assembly (10) and corresponding first and second portions (20', 22') of the second connector assembly (10') are pivotably connectable.

2. The connector assembly (10) of claim 1 wherein at least a portion of the periphery of at least one of the first and second portions (20, 22) of the connector assembly (10) and the first and second portions (20', 22') of the second connector assembly (10) includes a taper.

3. The connector assembly (10) of claim 1 wherein the corresponding contacts are hermaphroditic.

4. The connector assembly (10) of claim 1 wherein a protrusion is formed in at least one of the first and second portion (20, 22) of the connector assembly (10), and at least one of the first and second portion (20', 22') of the second connector assembly (10'), the protrusion formed in the first portion (20) extending toward the second portion (22), the protrusion formed in the second portion (22) extending toward the first portion (20), the protrusion formed in the first portion (20') extending toward the second portion (22'), the protrusion formed in the second portion (22') extending toward the first portion (20'), the protrusions extending toward each other upon coupling of the connector assemblies (10, 10').

5. The connector assembly (10) of claim 4 wherein each of the first portion (20) of the connector assembly (10) and the first portion (20') of the second connector assembly (10') has an angled region.

6. The connector assembly (10) of claim 5 wherein the angled region extends along at least a portion of the periphery of the first portion (20) of the connector assembly (10) and the first portion (20') of the second connector assembly (10').

7. The connector assembly (10) of claim 1 wherein the first and second connector assemblies (10, 10') are substantially identical.

8. The connector assembly (10) of claim 7 wherein the first and second portions (20, 22) of the connector assembly (10) and the first and second portions (20', 22') of the second connector assembly (10) are substantially parallel.

9. A panel member electrically connectable to a second panel member, the panel member comprising:

a connector assembly (10) secured to the panel member for electrically coupling with a second connector assembly (10') secured to the second panel member, the connector assembly (10) comprising:

a contact (14) having a first portion (20) and a second portion (22) disposed at a predetermined spacing from each other, the second connector assembly (10') including a contact (14') having a first portion (20') and a second portion (22') disposed at a predetermined spacing from each other, the predetermined spacing of the contact (14) of the connector assembly (10) being configured and disposed to receive the second portion (22') of the contact (14') of the second connector assembly (10'), the contact (14') of the second connector assembly (10') being configured and disposed to receive the second portion (22) of the contact (14) of the connector assembly (10), the panel members can be maintained parallel or non-parallel to each other while the connector assemblies (10, 10') are brought together from a plurality of directions; and wherein the second portion (22') of the second connector assembly (10') and corresponding first and second portions (20, 22) of the connector assembly (10), and the second portion (22) of the connector assembly (10) and corresponding first and second portions (20', 22') of the second connector assembly (10') are pivotably connectable.

10. The panel member of claim 9 wherein at least a portion of the periphery of at least one of the first and second portions (20, 22) of the connector assembly (10) and the first and second portions (20', 22') of the second connector assembly (10') includes a taper.

11. The panel member of claim 9 wherein the corresponding contacts are hermaphroditic.

12. The panel member of claim 9 wherein a protrusion is formed in at least one of the first and second portion (20, 22) of the connector assembly (10), and at least one of the first and second portion (20', 22') of the second connector assembly (10'), the protrusion formed in the first portion (20) extending toward the second portion (22), the protrusion formed in the second portion (22) extending toward the first portion (20), the protrusion formed in the first portion (20') extending toward the second portion (22'), the protrusion formed in the second portion (22') extending toward the first (20') portion, the protrusions extending toward each other upon coupling of the connector assemblies.

13. The panel member of claim 12 wherein each of the first portion (20) of the connector assembly (10) and the first portion (20') of the second connector assembly (10') has an angled region.

14. The panel member of claim 13 wherein the angled region extends along at least a portion of the periphery of the first portion (20) of the connector assembly (10) and the first portion (20') of the second connector assembly (10').

15. The panel member of claim 9 wherein the first and second connector assemblies (10, 10') are substantially identical.

16. The panel member of claim 15 wherein the first and second portions (20, 22) of the connector assembly (10) and the first and second portions (20', 22') of the second connector assembly (10') are substantially parallel.

* * * * *